US010391764B2

(12) United States Patent
Yamato

(10) Patent No.: US 10,391,764 B2
(45) Date of Patent: Aug. 27, 2019

(54) ELEMENT SUBSTRATE, PRINTHEAD, AND PRINTING APPARATUS

(71) Applicant: CANON KABUSHIKI KAISHA, Tokyo (JP)

(72) Inventor: Hidenori Yamato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/972,711

(22) Filed: May 7, 2018

(65) Prior Publication Data

US 2018/0333954 A1 Nov. 22, 2018

(30) Foreign Application Priority Data

May 16, 2017 (JP) ..... 2017-097513
Apr. 23, 2018 (JP) ..... 2018-082462

(51) Int. Cl.
*B41J 2/045* (2006.01)
*B41J 2/14* (2006.01)

(52) U.S. Cl.
CPC ..... *B41J 2/0451* (2013.01); *B41J 2/0458* (2013.01); *B41J 2/04508* (2013.01); *B41J 2/04528* (2013.01); *B41J 2/04541* (2013.01); *B41J 2/04543* (2013.01); *B41J 2/04563* (2013.01); *B41J 2/14* (2013.01)

(58) Field of Classification Search
CPC ..... B41J 2/04541; B41J 2/04543; B41J 2/04563; B41J 2/04565; B41J 2/0458; B41J 2/04508; B41J 2/0451
See application file for complete search history.

(56) References Cited

U.S. PATENT DOCUMENTS 7,587,625 B2 9/2009 Alexander et al.
9,333,743 B2 * 5/2016 Akune ..... B41J 2/04573
2007/0226579 A1 9/2007 Alexander et al.
2011/0273507 A1 * 11/2011 Yamato ..... B41J 2/04508 347/19

FOREIGN PATENT DOCUMENTS

JP 5039061 B 10/2012
WO 2007/098062 A2 8/2007

* cited by examiner

*Primary Examiner* — Jason S Uhlenhake
(74) *Attorney, Agent, or Firm* — Venable LLP

(57) ABSTRACT

An exemplary element substrate includes: function circuits for executing functions for a print operation; a discrimination circuit for receiving a data signal and transferring the received data signal to a corresponding function circuit in accordance with a result of discriminating the type of data included in the received data signal; and an error detection circuit for detecting whether a transfer error occurs in the received data signal. The detection result is reflected in a received latch signal and a received reset signal. In accordance with the executed functions, some function circuits are caused to latch the transferred data signal by the latch signal in which the detection result is reflected. On the other hand, remaining function circuits are caused to reset the transferred data signal by the reset signal in which the detection result is reflected.

20 Claims, 10 Drawing Sheets

ELEMENT SUBSTRATE, PRINTHEAD, AND PRINTING APPARATUS

BACKGROUND OF THE INVENTION

Field of the Invention

The present invention relates to an element substrate, a printhead, and a printing apparatus, and particularly to an element substrate on which a circuit including a plurality of print elements that print on a print medium and drive elements that drive the print elements is provided, a printhead using the element substrate, and a printing apparatus using the printhead.

Description of the Related Art

As a method of driving an inkjet printhead (to be referred to as a printhead hereinafter), there is known a method of providing an electrothermal transducer (heater) in a portion communicating with an orifice configured to discharge an ink droplet, supplying a current to the heater to generate heat, and causing film boiling of ink to discharge the ink droplet. A switching element is connected to each heater. When the switching element is turned on in accordance with data, the current flows to the heater. To drive a plurality of heaters provided in correspondence with a plurality of orifices arranged in a row, a method of dividing the plurality of heaters into a plurality of blocks and time-divisionally driving the heaters of each block is used in general.

FIG. 10 is a view showing the arrangement of a plurality of heaters integrated on the element substrate of a conventional printhead and transistors serving as switching elements that drive the heaters. FIG. 10 shows m×n heaters 1001-11 to **1001-*mn* and m×n transistors 1002-11 to 1002-*mn***. The m×n heaters are provided in m×n orifices, respectively.

As indicated by broken lines in FIG. 10, the m×n heaters and the m×n transistors are divided into m groups including n heaters and m groups including n transistors, respectively. That is, the m×n heaters and the m×n transistors are divided into m groups 1003-1 to **1003-*m* for every n heaters and n transistors, and the ground side of each heater 1001-*ij* is connected to an NMOS transistor 1002-*ij*. In FIG. 10, the nth print element in the mth group is represented by 1001-*mn***.

For example, the sources of the NMOS transistors **1002-*ml* to 1002-*mn* in the group m are electrically connected to a ground pad 1005. On the other hand, the heaters 1001-*ml* to 1001-*mn* are electrically connected to a power supply voltage pad 1004 configured to supply power from the outside. A driving signal is generated by data from a printing apparatus (not shown). When a driving voltage is applied to the gate of the NMOS transistor 1002-*ij*, a current flows to the corresponding heater 1001-*ij***. Thermal energy is applied to ink, and the ink is discharged from the orifice. As for the heaters in the same group, one heater is simultaneously driven at maximum in one block drive time by the time-divisional driving. For this reason, the voltage drop is constant regardless of the number of simultaneously driven heaters.

In addition, in a source follower arrangement in which the source of each NMOS transistor is connected to the power supply voltage, when a driving voltage is applied to the gate of the NMOS transistor, the heater is driven. In an arrangement in which an NMOS transistor and a PMOS transistor are arranged on both sides of a heater, when a driving voltage is applied to the gates of both transistors, the print element is driven.

When printing performed by a printhead is multicolor printing, the print width of the printhead is large, and the printing speed becomes high, the amount of signal data transferred to the printhead also increases, and the signal transfer path becomes long. This may cause an error in print data transfer.

For example, if a transfer error occurs in data used to select a heater, an incorrect heater is driven. If a transfer error occurs in a signal used to define the drive time, a driving pulse having a pulse width different from a desired width is generated, and as a result, the quality of a printed image lowers. Hence, conventionally, to prevent image quality degradation, a circuit configured to detect a transfer error is provided in the element substrate and, when an error occurs in data, control is performed to stop heater driving at the next time-division timing.

In addition, transfer data from the printing apparatus main body includes not only data used to select a heater but also data used to perform warm-up control of a heater from the printing apparatus based on the temperature information of the element substrate and data used to select various kinds of error information and the like and transmit them to the printing apparatus from the printhead. For example, since an ink discharge amount or ink discharge speed varies depending on the detected temperature of the element substrate, execution of temperature control based on incorrect data needs to be prevented.

As described above, along with the speed up of data transfer or an increase in the data amount, it is necessary to detect whether data transfer is normally performed, and if an error is detected, quickly take an appropriate countermeasure to cope with it. For example, Japanese Patent No. 5039061 proposes an arrangement in which load from a memory causes an error, the load is reset quickly, and reload is performed, thereby preventing an operation error according to the error.

In a full-line printhead having a long print width and many orifices, a plurality of element substrates are integrated, and the number of terminals and the number of wirings in the printhead increase. Hence, these need to be suppressed as much as possible. In addition, the data transfer rate is required to be higher, as a matter of course. Under those restrictions, instead of transferring data to all of many functions of the printhead in each transfer operation, an arrangement that transfers only a necessary amount of data at a timing of executing a target function is employed.

However, along with the recent increase in the data transfer rate to the printhead, there is no time margin to reset the memory and perform reload as in Japanese Patent No. 5039061. Hence, target processing needs to be performed only one transfer.

In addition, in a case in which a method of transferring data at any desired period instead of transferring data in each transfer operation is employed, if the data signal is reset, the corresponding function cannot be used until the next period. For this reason, there is a possibility that the print operation cannot be executed normally, and a print medium is wasted.

Furthermore, in a method of receiving an error detection result from the printhead on the printing apparatus main body side and performing print control in correspondence with the result, since feedback control takes time, and it is therefore necessary to complete processing corresponding to error occurrence in the element substrate.

SUMMARY OF THE INVENTION

Accordingly, the present invention is conceived as a response to the above-described disadvantages of the conventional art.

For example, an element substrate according to this invention is capable of resetting or latching a signal in consideration of a role played by each function circuit even if a transfer error occurs.

According to one aspect of the present invention, there is provided an element substrate on which a plurality of print elements and a plurality of drive elements configured to drive the plurality of print elements are integrated, comprising: a plurality of function circuits configured to execute a plurality of functions necessary to execute a print operation; a data discrimination circuit configured to receive a data signal from an outside, discriminate a type of data included in the received data signal, and transfer the received data signal to a corresponding function circuit of the plurality of function circuits in accordance with a result of the discrimination; an error detection circuit configured to receive the data signal and detect whether a transfer error occurs in the received data signal; and a control circuit configured to control to reflect a detection result of the error detection circuit in a latch signal received from the outside and a reset signal received from the outside and, in accordance with the functions executed by the plurality of function circuits, cause some function circuits of the plurality of function circuits to latch the transferred data signal by the latch signal on which the detection result is reflected and cause remaining function circuits of the plurality of function circuits to reset the transferred data signal by the reset signal in which the detection result is reflected.

According to another aspect of the present invention, there is provided a printhead having the above arrangement.

According to still another aspect of the present invention, there is provided a printing apparatus for printing on a print medium, using the above printhead.

The invention is particularly advantageous since it is possible to reset or latch a signal in consideration of a role played by each function circuit even if a transfer error occurs. Accordingly, as for execution of a certain function, even if a transfer error occurs, an operation is performed using data held before, thereby quickly coping with the error.

Further features of the present invention will become apparent from the following description of exemplary embodiments (with reference to the attached drawings).

DESCRIPTION OF THE EMBODIMENTS

Figure 1:
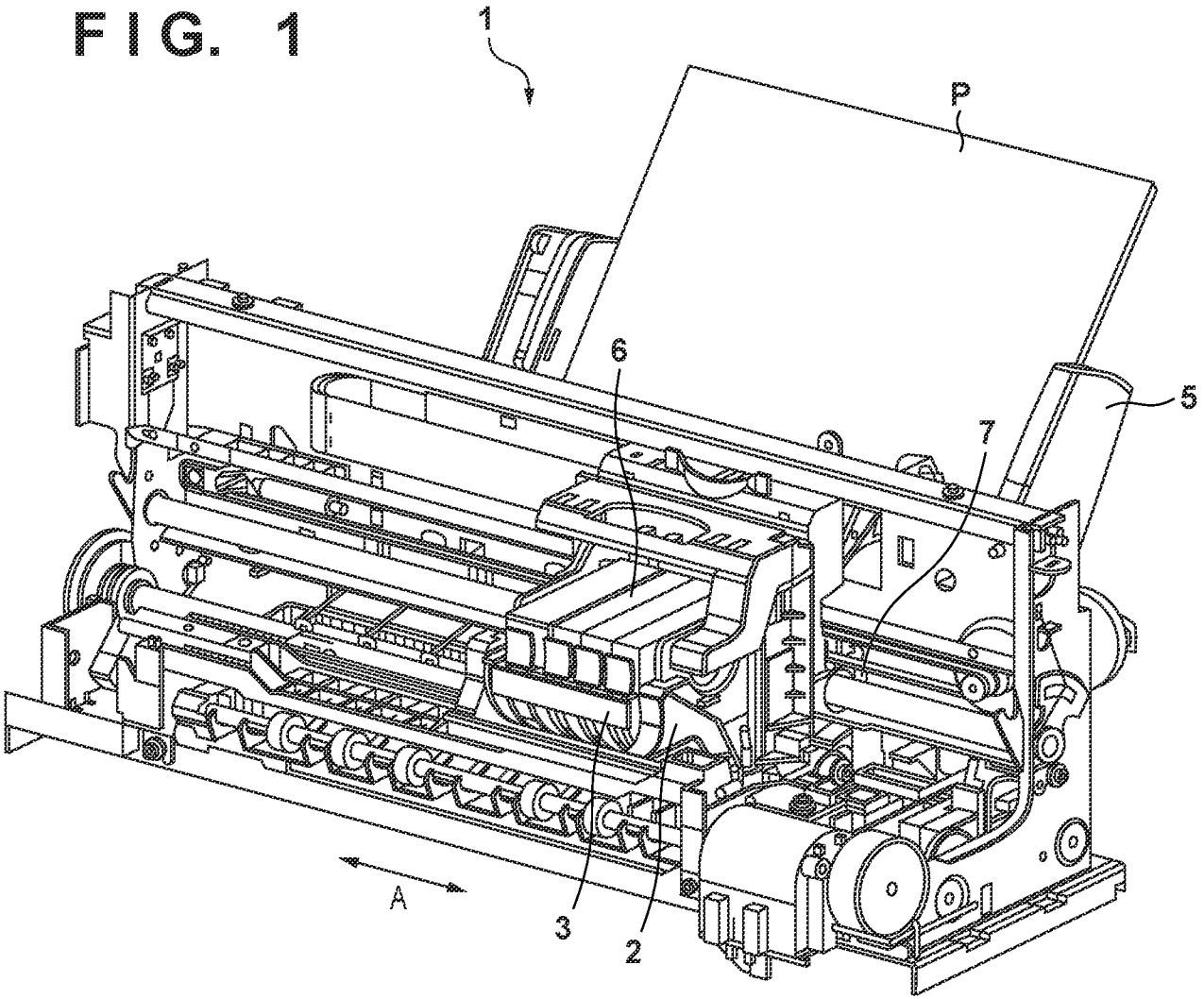
FIG. 1 is a perspective view showing the schematic arrangement of a printing apparatus according to an exemplary embodiment of the present invention, which performs printing by discharging ink from an inkjet printhead.

Exemplary embodiments of the present invention will now be described in detail in accordance with the accompanying drawings. Note that in the following description, the same constituent elements will be mentioned with the same reference numerals throughout the drawings. Hence, constituent elements described once will be mentioned using the same reference numerals, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted to be similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element (or nozzle)" generically means an ink orifice or a liquid channel communicating with it, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Description of Inkjet Printing Apparatus (FIG. 1)>

FIG. 1 is an outside perspective view showing the schematic arrangement of an inkjet printing apparatus 1 according to an exemplary embodiment of the present invention.

As shown in FIG. 1, the inkjet printing apparatus (to be referred to as a printing apparatus hereinafter) mounts, on a carriage 2, an inkjet printhead (to be referred to as a printhead hereinafter) 3 that performs printing by discharging ink in accordance with an inkjet method, and reciprocally moves the carriage 2 in the direction of an arrow A, thereby performing printing. A print medium P such as print paper is fed via a feed mechanism 5 and conveyed up to a print position. At the print position, the printhead 3 discharges ink to the print medium P, thereby performing printing.

Not only the printhead 3 is mounted on the carriage 2 of the printing apparatus 1. An ink cartridge 6 that stores ink to be supplied to the printhead 3 is also attached to the carriage 2. The ink cartridge 6 is detachable from the carriage 2.

The printing apparatus 1 shown in FIG. 1 can perform color printing. For this purpose, four ink cartridges that store magenta (M), cyan (C), yellow (Y), and black (K) inks, respectively, are mounted on the carriage 2. The four ink cartridges can independently be detached.

The printhead 3 according to this embodiment employs an inkjet method of discharging ink using thermal energy. Hence, the printhead 3 includes an electrothermal transducer. The electrothermal transducer is provided in correspondence with each orifice. When a pulse voltage is applied to a corresponding electrothermal transducer in accordance with a print signal, ink is discharged from a corresponding orifice.

<Control Configuration of Inkjet Printing Apparatus (FIG. 2)>

Figure 2:
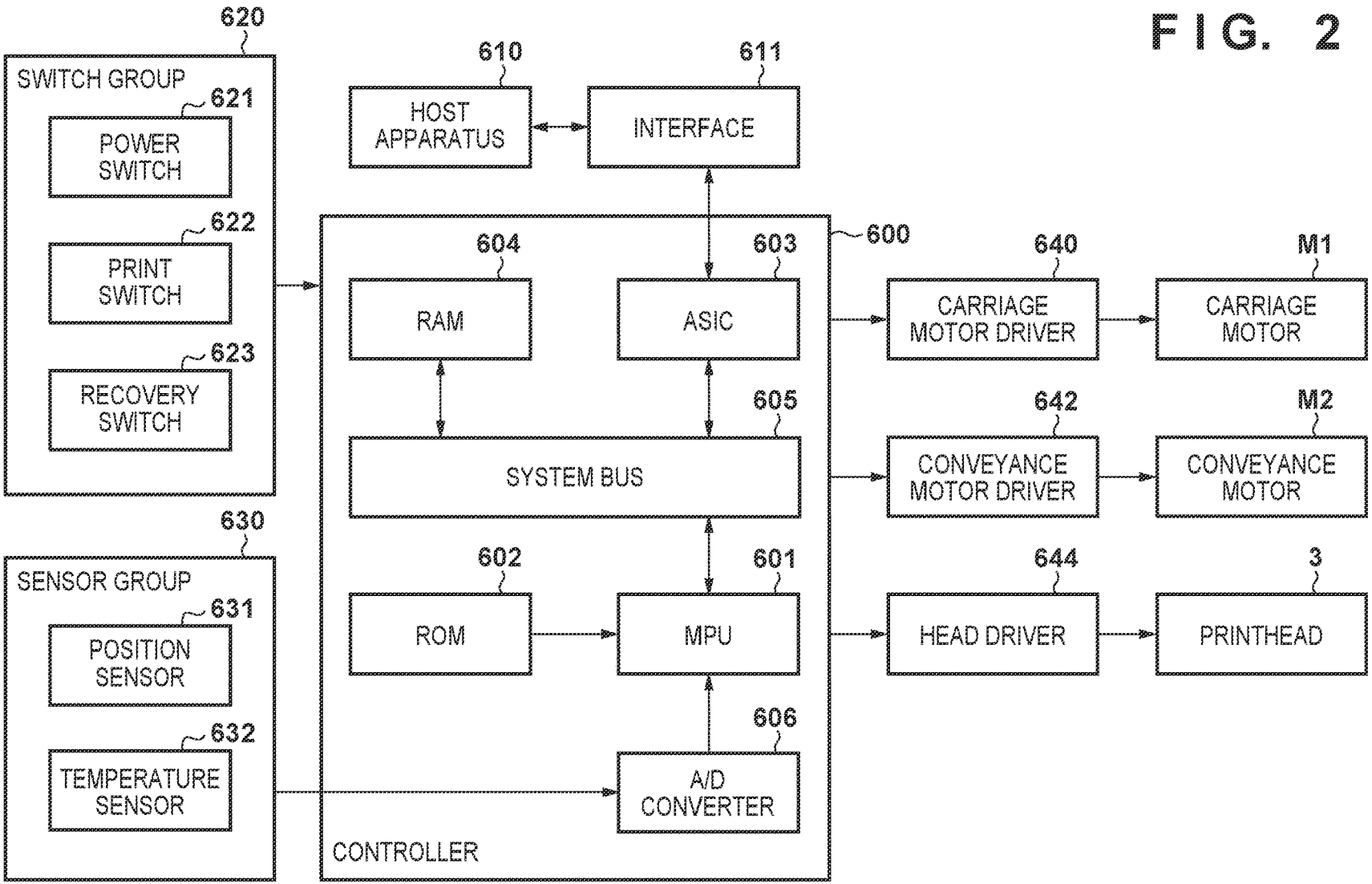
FIG. 2 is a block diagram showing the control configuration of the printing apparatus shown in FIG. 1.

FIG. 2 is a block diagram showing the control configuration of the printing apparatus shown in FIG. 1.

As shown in FIG. 2, a controller 600 is formed from an MPU 601, a ROM 602, an application specific integrated circuit (ASIC) 603, a RAM 604, a system bus 605, an A/D converter 606, and the like. Here, the ROM 602 stores a program corresponding to a control sequence to be described later, a required table, and other permanent data. The ASIC 603 generates control signals for control of a carriage motor M1, control of a conveyance motor M2, and control of the printhead 3. The RAM 604 is used as a rasterization area for image data, a work area for program execution, and the like. The system bus 605 connects the MPU 601, the ASIC 603, and the RAM 604 to each other and exchanges data. The A/D converter 606 receives an analog signal from a sensor group to be described below, A/D-converts the signal, and supplies a digital signal to the MPU 601.

Also, referring to FIG. 2, reference numeral 610 denotes a computer (or a reader for image reading or a digital camera) that is an image data supply source and is generally called a host apparatus. The host apparatus 610 and the printing apparatus 1 transmit/receive image data, commands, status signals, and the like via an interface (I/F) 611. The image data is input in, for example, a raster format.

In addition, reference numeral 620 denotes a switch group including a power switch 621, print switch 622, a recovery switch 623, and the like.

Reference numeral 630 denotes a sensor group configured to detect an apparatus state, which includes a position sensor 631, a temperature sensor 632, and the like.

Furthermore, reference numeral 640 denotes a carriage motor driver that drives the carriage motor M1 configured to make the carriage 2 reciprocally scan in the direction of the arrow A; and 642, a conveyance motor driver that drives the conveyance motor M2 configured to convey the print medium P. In addition, reference numeral 644 denotes a head driver that drives the printhead based on print data or a control signal transferred from the controller 600.

At the time of print scan by the printhead 3, the ASIC 603 transfers data used to drive a print element (heater for discharge) to the printhead while directly accessing the storage area of the RAM 604. In addition, the ASIC 603 transfers, to the printhead, data (start instruction data/stop instruction data) used to control the temperature of the element substrate in the printhead 3 and detection element selection data used to select a detection element from a plurality of detection elements. For these data, a data update interval is defined for each type of data. For this reason, the data transfer interval changes depending on the type of data. The ASIC 603 also outputs a reset signal RESET of "H" (high level) to the printhead for a predetermined time at the time of, for example, power-on. Otherwise, the ASIC 603 outputs the reset signal RESET of "L" (low level) to the printhead. Upon receiving the reset signal RESET of "H", the circuits of the element substrate in the printhead 3 are initialized. Note that the timing at which the ASIC 603 outputs the signal of "H" (high level) may be another timing. For example, the signal may be output at a timing after input of a pulse signal of "L" (low level) as a latch signal LT before input to a data signal DATA.

Embodiments of the element substrate integrated on the printhead mounted in the printing apparatus with the above-described arrangement will be described next.

Figure 10:
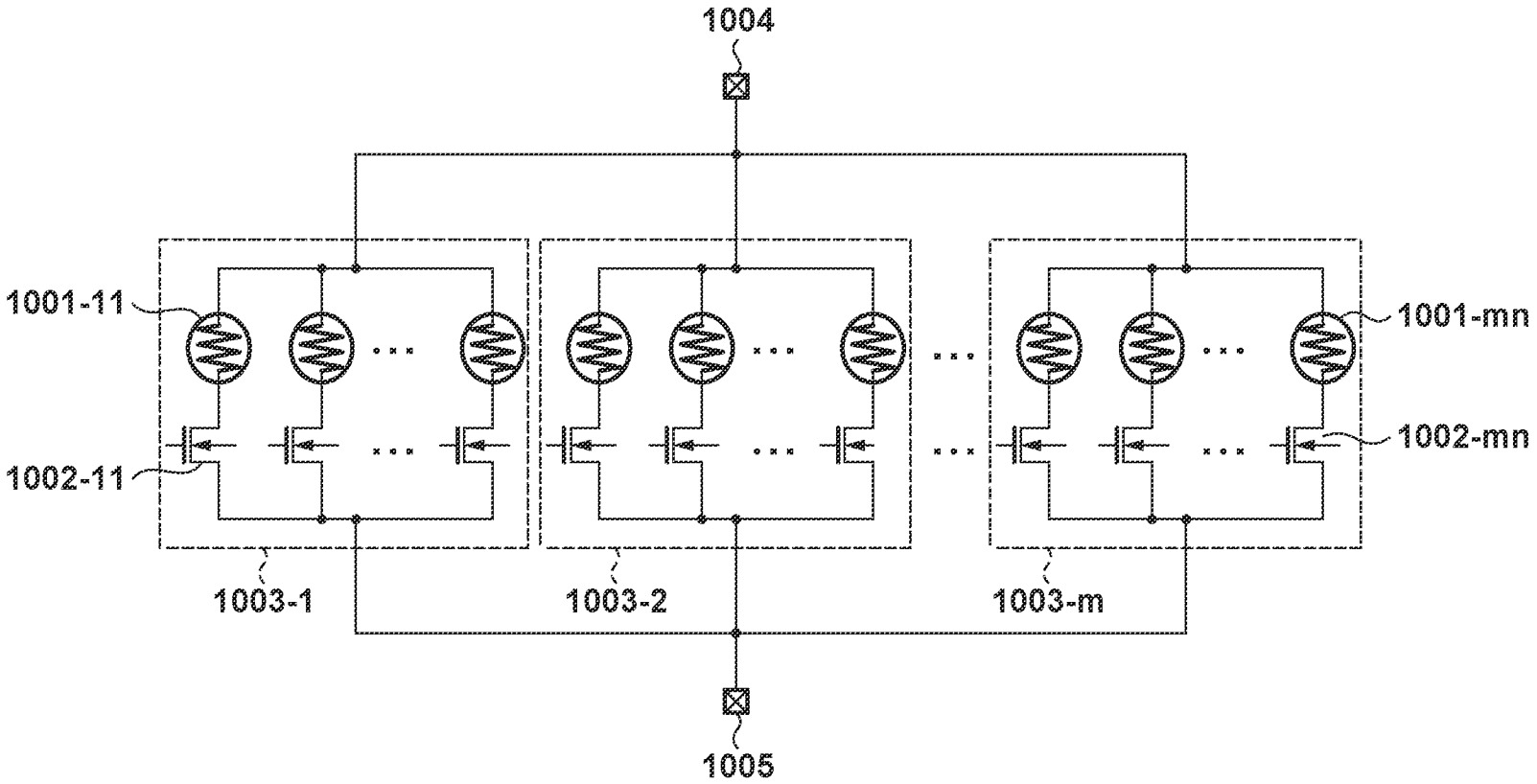
FIG. 10 is a view showing the arrangement of a plurality of heaters integrated on the element substrate of a conventional printhead and transistors serving as switching elements that drive the heaters.

Note that in the embodiments, a description will be made assuming that the driving configuration of a print element as described with reference to FIG. 10 is used. However, another configuration may be used as the driving configuration. In the embodiments to be described below, particularly, an arrangement in which for an error that occurs in the printhead (element substrate), the element substrate copes with the error in a self-contained manner will be described.

First Embodiment

Figure 3:
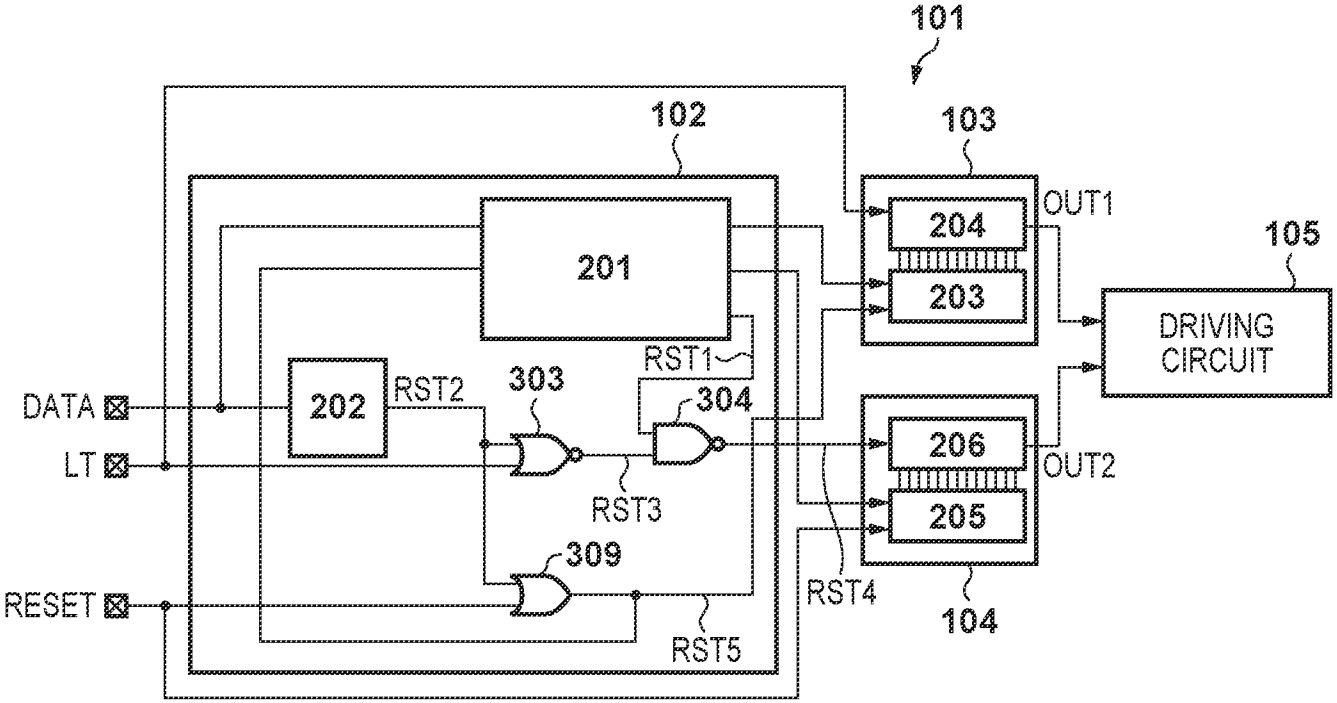
FIG. 3 is a block diagram showing the schematic arrangement of an element substrate according to the first embodiment.

FIG. 3 is a block diagram showing the schematic arrangement of an element substrate according to the first embodiment.

As shown in FIG. 3, an element substrate 101 is formed from a data reception circuit 102, a print element selection circuit 103, a drive time generation circuit 104, and a driving circuit 105. The element substrate 101 also includes a reception terminal configured to receive a data signal DATA, a reception terminal configured to receive a latch signal LT, and a terminal configured to receive a reset signal RESET.

The data reception circuit 102 is formed from a data discrimination circuit 201 and an error detection circuit 202. The data discrimination circuit 201 discriminates the data signal DATA received from the outside, transfers it to a corresponding function circuit, and outputs a data presence/absence discrimination result RST1 representing whether drive time generation data is sent. Note that the data reception circuit 102 transfers corresponding data to each function circuit regardless of the presence/absence of an error in data.

Function circuits here correspond to the print element selection circuit 103 and the drive time generation circuit 104. When time-divisionally driving the plurality of print elements of a printhead 3, the print element selection circuit 103 performs a specific function of receiving a print data signal from the data reception circuit 102 and selecting a print element to be driven in each block based on the print data signal. On the other hand, when time-divisionally driving the plurality of print elements of the printhead 3, the drive time generation circuit 104 performs a specific function of receiving a drive time signal that defines a time to drive the print element from the data reception circuit 102 and transmitting the drive time signal to the driving circuit 105. As described above, the print element selection circuit 103 and the drive time generation circuit 104 are circuits that perform the specific functions in the print operation and are therefore called function circuits in general.

The error detection circuit 202 checks whether an error has not occurred in transfer of the data signal DATA. More specifically, a parity check circuit or a CRC circuit is used as the circuit. The print element selection circuit 103 is formed from a shift register 203 and a latch circuit 204. The drive time generation circuit 104 is formed from a shift register 205 and a latch circuit 206. Results OUT1 and OUT2 output from the print element selection circuit 103 and the drive time generation circuit 104 are calculated by the driving circuit 105, and a print element is driven by a corresponding switching element (drive element) in accordance with the driving configuration explained with reference to FIG. 10. Hence, the same circuit as shown in FIG. 10 is integrated as the driving circuit 105.

A NOR circuit 303 calculates the NOR of a detection result RST2 output from the error detection circuit 202 and the latch signal LT received from the outside. A NAND circuit 304 calculates the NAND of a calculation result RST3 and the data presence/absence discrimination result RST1. A calculation result RST4 obtained by the NAND circuit 304 is transmitted to the latch circuit 206 of the drive time generation circuit 104. In addition, an OR circuit 309 calculates the OR of the detection result RST2 from the error detection circuit 202 and the reset signal received from the outside. A calculation result RST5 is transmitted to the shift register 203 of the print element selection circuit 103.

The circuit arrangement shown in FIG. 3 can be summarized as follows.

The data signal DATA, the latch signal LT used to cause a latch circuit to latch the data signal, and the reset signal RESET that resets the data signal DATA held in the element substrate are input from the outside (the controller 600 of the printing apparatus) to the element substrate 101. In the element substrate 101, it is checked whether the received data signal DATA includes a transfer error or not, and the result is reflected in the received latch signal LT and reset signal RESET.

The shift register 203 of the print element selection circuit 103 holds the print data signal discriminated by the data discrimination circuit 201 and, on the other hand, resets (clears) the held print data signal by the reset signal RESET in which the error detection result is reflected. Hence, in the shift register 203, the held print data signal is cleared by the calculation result RST5. That is, when a transfer error occurs, the latch circuit 204 of the print element selection circuit 103 latches the clear data held by the shift register 203. On the other hand, the latch circuit 204 of the print element selection circuit 103 latches the print data signal held by the shift register 203 by the received latch signal LT.

On the other hand, the shift register 205 of the drive time generation circuit 104 holds the heat signal discriminated by the data discrimination circuit 201 and resets the held heat signal by the received reset signal RESET. In this embodiment, if the reset signal RESET is "H", the contents of the shift register 205 are reset (cleared). On the other hand, the latch circuit 206 of the drive time generation circuit 104 latches the heat signal held by the shift register 205 by the latch signal LT in which the transfer error detection result is reflected. More specifically, when a transfer error does not occur, the latch circuit 206 receives a signal of the same logic as the latch signal LT received by the reception circuit 102. That is, the latch circuit 206 directly receives the latch signal LT. Hence, the latch circuit 206 latches the heat signal held by the shift register 205. However, if a transfer error occurs, even if the reception circuit 102 receives the latch signal LT, transfer of the latch signal LT to the latch circuit 206 is suppressed because the transfer error detection result is reflected in the logic of the signal. Hence, when a transfer error occurs, the latch circuit 206 does not latch the heat signal held by the shift register 205. For this reason, the latch circuit 206 continuously holds the heat signal latched before the occurrence of the transfer error.

With the above-described circuit arrangement, an operation in which the transfer error detection result is reflected in resetting of the print data signal in the print element selection circuit 103, and the transfer error detection result is reflected in latching of the heat signal in the drive time generation circuit 104 is executed.

Figure 4:
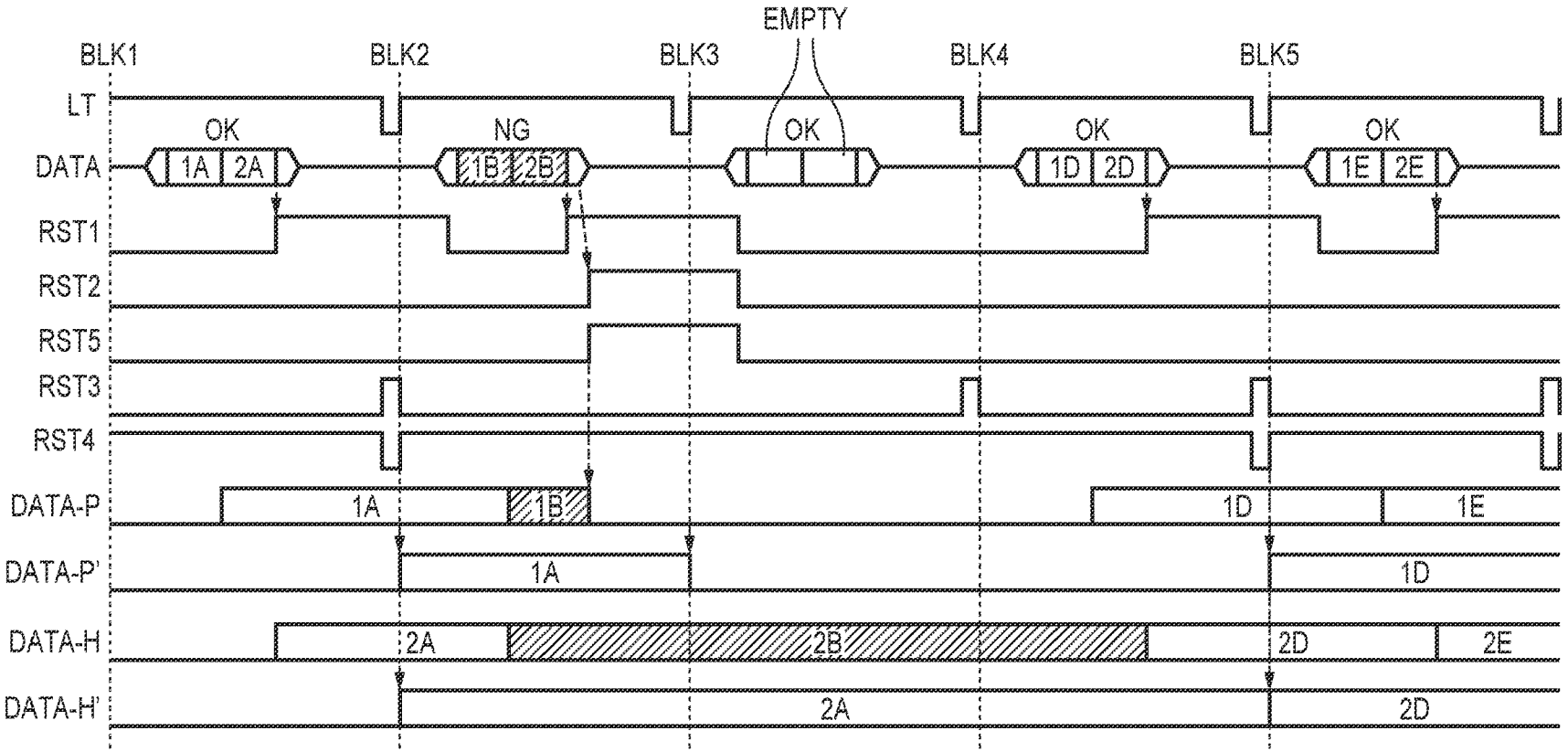
FIG. 4 is a timing chart of external signals input to the element substrate shown in FIG. 3 and various signals generated in the element substrate.

FIG. 4 is a timing chart of external signals input to the element substrate shown in FIG. 3 and various signals generated in the element substrate.

As the data signal DATA, only a data signal necessary for each print operation is transmitted from the printing apparatus main body. The header of the data signal DATA includes data to be received by the data discrimination circuit 201, and the footer includes data that the error detection circuit 202 delimits by executing error detection processing. Since the plurality of print elements integrated in the printhead 3 are time-divisionally driven, print data used for printing of print elements in each of blocks (BLK1, BLK2, . . . ) is latched by the latch signal LT. FIG. 4 shows input of data signals corresponding to five blocks (BLK1 to BLK5). For the descriptive convenience, assume that data signals of different states are input to these blocks. If the state is different, the element substrate 101 performs a different operation. An operation according to data signal input in each block will be described below in detail. Note that throughout the period shown in FIG. 4, the state of the reset signal RESET received from the outside is "L" (not shown).

Data Signal Input in Block BLK1 (Normal Signal Input)

According to FIG. 4, concerning the first block BLK1, normal signals 1A and 2A are inserted between the header and the footer of the data signal DATA. The signal 1A is print element selection data, and the signal 2A is drive time generation data. After reception, the signals 1A and 2A are transferred to the corresponding shift registers 203 and 205, respectively. In FIG. 4, data stored in the shift register 203 is represented by DATA-P, and data stored in the shift register 205 is represented by DATA-H.

If the result of error detection processing delimited by the footer is OK (error does not exist: normal), the error detection result RST2 of "L" is output. When the data discrimination circuit 201 receives the drive time generation data, "H" is output as the data presence/absence discrimination signal RST1 at the timing of discrimination of the data (heat signal). As a result, the calculation result RST4 of the NAND circuit 304, which is input to the latch circuit 206 of the drive time generation circuit 104, becomes the same signal as the latch signal LT.

At the leading edge of the latch signal LT of the block BLK2, the signals 1A and 2A are latched and stored in the corresponding latch circuits 204 and 206, respectively. In FIG. 4, these are represented by DATA-P' and DATA-H', and desired print elements are driven in the driving circuit 105 by the signals.

Data Signal Input in Block BLK2 (Abnormal Signal Input)

According to FIG. 4, a case in which a signal representing that data transfer is determined as an error is detected is shown for the next block BLK2.

As shown in FIG. 4, since drive time generation data is transmitted from the printing apparatus main body as a signal 2B, "H" is output as the data presence/absence discrimination signal RST1 at the timing of discrimination of the data (heat signal), as in the block BLK1. On the other hand, since the result of error detection processing by the error detection circuit 202 is NG (error exists: abnormal), "H" is output as the error detection result RST2 after the error delimitation by the footer data. As a result, the calculation result RST3 of the NOR circuit 303, in which the error detection result is reflected, becomes "L". However, since the calculation result RST4 of the NAND circuit 304, which is input to the latch circuit 206 of the drive time generation circuit 104, remains "H", the signal 2B is not latched, and the signal 2A is held.

In addition, the OR circuit 309 calculates the OR of the error detection result RST2 of "H" and the reset signal RESET input from the outside, and the calculation result RST5 is input to the shift register 203 of the print element selection circuit 103. As a result, the data input to the shift register 203 is cleared. Hence, the latch circuit 204 does not latch a signal 1B, unlike the block BLK1.

Note that the error detection result RST2 returns to "L" at the time of starting reception of the header of data in the next block BLK3. If the error detection result RST2 is returned to "L" at the timing of the leading edge of the latch signal LT in the block BLK3, the error detection result RST2 may fall before the latch signal LT rises to "H". In that case, since the data is latched by the latch circuit 206, the error detection result RST2 needs to be reliably returned to "L" after the latch signal LT. In addition, after the error is delimited by the footer of the data, and the error detection result RST2 is output, the data in the shift register 205 needs to be reset until the next latch signal LT. This is because the data DATA-P of the signal 1B is latched by the latch circuit 204 otherwise.

Data Signal Input in Block BLK3 (Data Input that does not Cause Print Operation)

According to FIG. 4, in the block BLK3, the data signal DATA received by the element substrate does not include print element selection data and drive time generation data.

In this case, the data presence/absence discrimination result RST1 changes to "L", and the calculation result RST4 input to the latch circuit 206 of the drive time generation circuit 104 remains "H" because of the absence of the drive time generation data. For this reason, the latch circuit 206 does not latch the input data signal at the first timing in the block BLK4 and holds the previous signal 2A.

On the other hand, since the result of error detection processing by the error detection circuit 202 is OK (error does not exist: normal), the error detection result RST2 changes to "L", and the calculation result RST5 input to the print element selection circuit 103 changes to "L". Accordingly, the shift register 203 of the print element selection circuit 103 sends the contents cleared in the block BLK2 to the latch circuit 204. If the data that causes the print operation is not included for a plurality of blocks, the state of the block BLK3 continues.

Data Signal Input in Blocks BLK4 and BLK5 (Normal Signal Input)

In the block BLK4, the print element selection data and the drive time generation data are included. In this case, if the error detection result RST2 representing that the result of error detection processing by the error detection circuit 202 is OK is output, the same operation as the above-described operation in the block BLK1 is performed. Hence, normal data is latched by a corresponding circuit at the leading edge of the latch signal LT in the block BLK5.

Hence, according to the above-described embodiment, if a transfer error of a data signal occurs, print element selection data is reset. However, drive time generation data is not latched and can be held until data for confirming a normal state is obtained by error detection processing. This can prevent a print element from being driven by incorrect data. By holding the drive time generation data that is not transferred for each block, the print operation can be resumed as soon as the data transfer is resumed. In the above-described way, data for which update occurs and data for which update does not occur are discriminated by the block period of time-divisional driving of the print elements, and reset and latch according to the discrimination are performed. Note that in FIG. 3 of the first embodiment, the data discrimination circuit 201 outputs the data presence/absence discrimination result RST1. However, if discrimination of the presence/absence of data is unnecessary, the NAND circuit 304 may be omitted, and the latch circuit 206 may receive the calculation result RST3 from the NOR circuit 303.

<Modification>

The element substrate described here includes one data discrimination circuit. However, a plurality of data discrimination circuits may be provided in correspondence with a plurality of data signal inputs.

Figure 5:
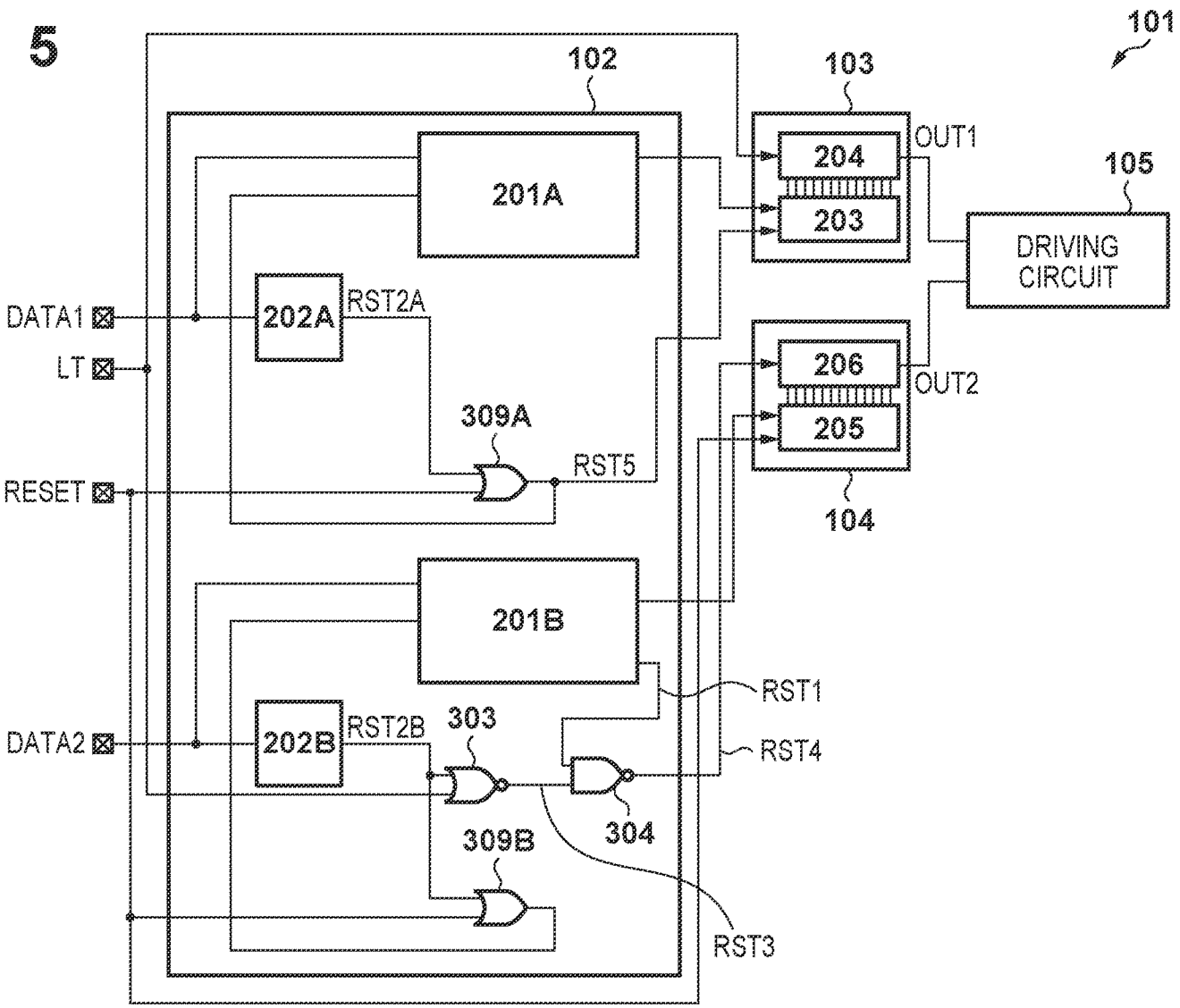
FIG. 5 is a block diagram showing the schematic arrangement of an element substrate according to a modification of the first embodiment.

FIG. 5 is a block diagram showing the schematic arrangement of an element substrate according to the modification of the first embodiment. An example in which two data discrimination circuits having identical arrangements are integrated is shown here. Note that the same reference numerals and symbols as in FIG. 3 denote the already described constituent elements and signals in FIG. 5, and a description thereof will be omitted. Data discrimination circuits 201A and 201B are provided in correspondence with the print element selection circuit 103 and the drive time generation circuit 104, respectively. In addition, the data discrimination circuits 201A and 201B are circuits having identical arrangements and having the same arrangement as the data discrimination circuit 201 described with reference to FIG. 3. Error detection circuits 202A and 202B are also circuits having identical arrangements and having the same arrangement as the error detection circuit 202 described with reference to FIG. 3. The data discrimination circuits 201A and 201B are different in that the data discrimination circuit 201A does not output the signal RST1, and the data discrimination circuit 201B outputs the signal RST1. In this modification as well, the data reception circuit 102 transfers corresponding data to each function circuit regardless of the presence/absence of an error in data.

In the example shown in FIG. 5, a data signal DATA1 is input to the data discrimination circuit 201A, and a data signal DATA2 is input to the data discrimination circuit 201B. The error detection circuit 202A executes error detection processing for the data signal DATA1, and the error detection circuit 202B executes error detection processing for the data signal DATA2. The data discrimination circuit 201B outputs the data presence/absence discrimination result RST1 as in the first embodiment.

When the error detection circuit 202A detects an error, an OR circuit 309A calculates the OR of an error detection result RST2A and the input reset signal RESET, and the shift register 203 of the print element selection circuit 103 is reset by the calculation result RST5. On the other hand, when the error detection circuit 202B detects an error, the NOR circuit 303 calculates the NOR of an error detection result RST2B and the input latch signal LT. The NAND circuit 304 calculates the NAND of the calculation result RST3 and the data presence/absence discrimination result RST1. The NAND circuit 304 outputs the calculation result RST4 to the latch circuit 206. The latch circuit 206 of the drive time generation circuit 104 is not caused to perform the latch operation until a normal data signal is received next.

With the above-described circuit arrangement, when either error detection circuit detects a transfer error, the shift register is reset, or the latch operation of the latch circuit is suppressed, thereby suppressing a normal print operation (driving of a print element). In addition, since separate data signal input terminals and data discrimination circuits are provided, output of the data presence/absence discrimination result RST1 is not needed for the data signal DATA1.

Note that the circuit arrangement shown in FIG. 5 is merely an example, and the data discrimination circuits, the error detection circuits, and the function circuits can be connected in any combination.

Second Embodiment

Figure 6:
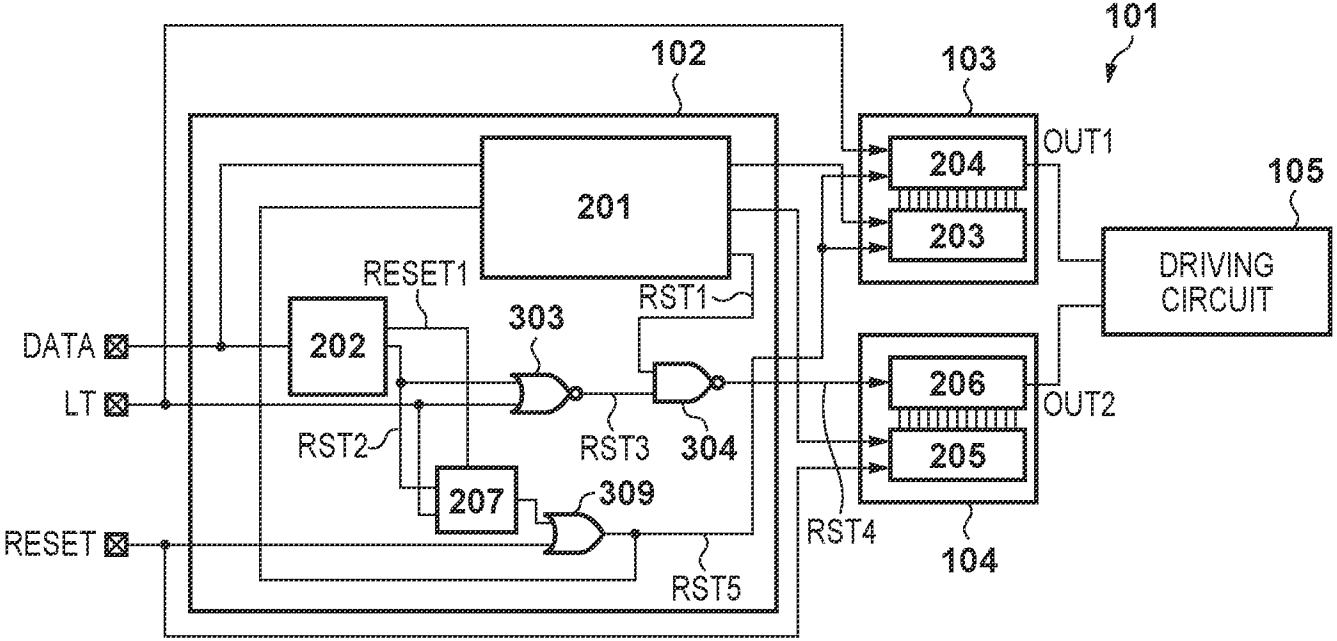
FIG. 6 is a block diagram showing the schematic arrangement of an element substrate according to the second embodiment.

FIG. 6 is a block diagram showing the schematic arrangement of an element substrate according to the second embodiment. Note that the same reference numerals and symbols as in FIG. 3 denote the already described constituent elements and signals in FIG. 6, and a description thereof will be omitted. As can be seen from comparison between FIG. 6 and FIG. 3, in this element substrate, the OR of an error detection result RST2 and a reset signal RESET is calculated by an OR circuit 309 via a latch circuit 207, and a calculation result RST5 is connected to a shift register 203 and a latch circuit 204. When the calculation result RST5 is input, signals input to the shift register 203 and the latch circuit 204 are cleared.

According to this arrangement, if the reset of the shift register 203 is not done in time until the leading edge of a next latch signal LT after output of the error detection result RST2, the latch circuit 207 latches the error detection result RST2 at the leading edge of the latch signal LT in the next block. The latched error detection result RST2 is transmitted anew to the shift register 203 and the latch circuit 204 as the calculation result RST5 that is the result of the OR operation with the input reset signal RESET. Note that the latch circuit 207 is reset by a reset signal RESET1 output from an error detection circuit 202.

Figure 7:
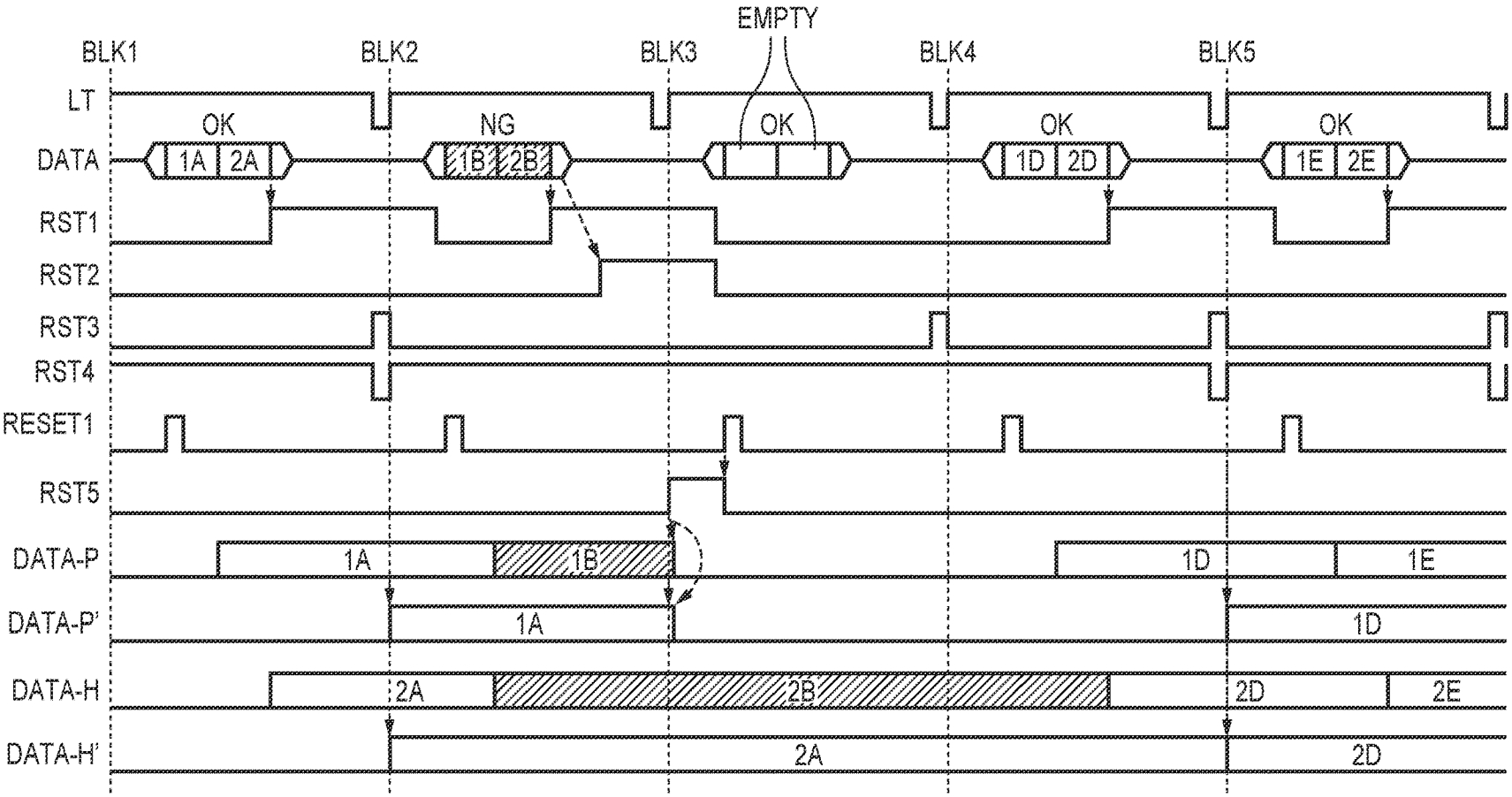
FIG. 7 is a timing chart of external signals input to the element substrate shown in FIG. 6 and various signals generated in the element substrate.

FIG. 7 is a timing chart of external signals input to the element substrate shown in FIG. 6 and various signals generated in the element substrate. Note that the same symbols as in FIG. 4 denote the already described signals and operations according to the signals in FIG. 7, and a description thereof will be omitted. Note that throughout the period shown in FIG. 7 as well, the state of the reset signal RESET received from the outside is "L" (not shown).

As shown in FIG. 7, an incorrect signal 1B input to the shift register 203 may be temporarily input to the latch circuit 204 at the time of the latch operation to the latch circuit 204. However, according to the circuit arrangement of the element substrate of this embodiment, the latch circuit 204 is reset when the calculation result RST5 is input to the latch circuit 204 as well at the leading edge of the latch signal LT in a block BLK3. In addition, the error detection circuit 202 outputs the reset signal RESET1 at the start of reception of the data header in the block BLK3, thereby resetting the latch circuit 207. Accordingly, the calculation result RST5 falls before the next data signal for block drive after the header is input.

Hence, according to the above-described embodiment, in a case in which a transfer error of a data signal is detected, even if the reset of the shift register that stores the data signal is not done in time until the leading edge of the next latch signal, the reset is possible as long as the error detection result is output. For this reason, the timing restriction until the error detection processing time and the latch operation of the data signal is relaxed.

Third Embodiment

Figure 8:
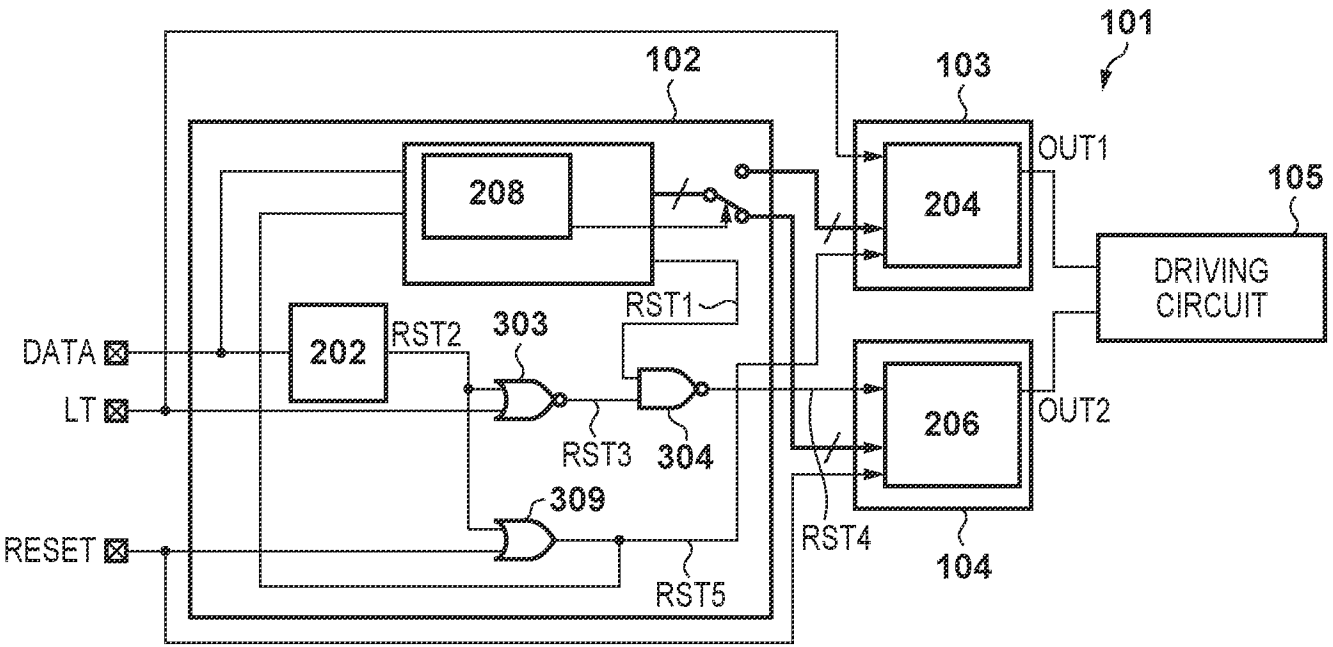
FIG. 8 is a block diagram showing the schematic arrangement of an element substrate according to the third embodiment.

FIG. 8 is a block diagram showing the schematic arrangement of an element substrate according to the third embodiment. Note that the same reference numerals and symbols as in FIG. 3 denote the already described constituent elements and signals in FIG. 8, and a description thereof will be omitted. As can be seen from comparison between FIG. 8 and FIG. 3, this element substrate is characterized in that each of a print element selection circuit 103 and a drive time generation circuit 104 does not include a shift register, and a shift register 208 is provided in a data discrimination circuit 201.

In this element substrate, as soon as to which function data received by the data discrimination circuit 201 corresponds is discriminated, a switch 217 is changed over in accordance with the discrimination result to transfer the corresponding data to a corresponding latch circuit 204 or 206 as the transfer destination.

Data received by the data discrimination circuit 201 and stored in the shift register 208 is reset when an error detection result RST2 indicates an error (H). However, since the error detection result RST2 is delimited by the footer of the transfer data, previously transferred error data is already transmitted by the latch circuit 204 or 206. For this reason, the data in the latch circuit 204 of the print element selection circuit 103 is reset by inputting a reset signal RST5 at the time of error detection.

On the other hand, at the time of error detection, the latch circuit 206 of the drive time generation circuit 104 does not latch the data and holds previous data until normal data is transferred.

Hence, according to the above-described embodiment, it is possible to prevent a print element from being driven by incorrect data at the time of a data transfer error, as in the first embodiment, and it is also possible to hold the drive time generation data that is not transferred for each block. This makes it possible to resume driving of the print element as soon as normal data is transferred.

In addition, according to this embodiment, the shift registers provided in the print element selection circuit and the drive time generation circuit in the first embodiment are arranged in the circuit on the data receiving side. With this arrangement, the number of wirings from the data reception circuit to each function circuit increases, as compared to the first embodiment. However, the circuit area on each function circuit side can be reduced.

Fourth Embodiment

Figure 9:
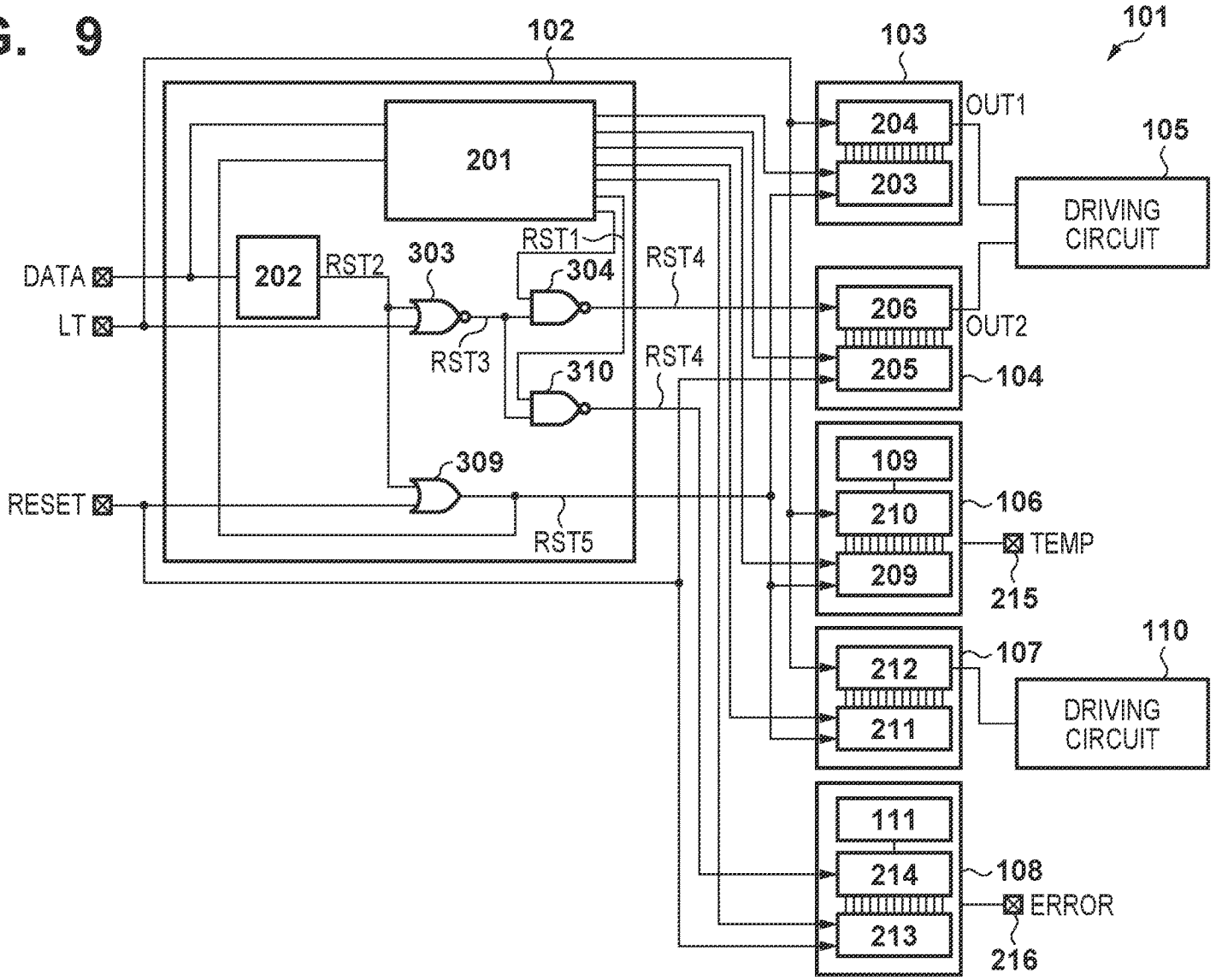
FIG. 9 is a block diagram showing the schematic arrangement of an element substrate according to the fourth embodiment.

FIG. 9 is a block diagram showing the schematic arrangement of an element substrate according to the fourth embodiment. Note that the same reference numerals and symbols as in FIG. 3 denote the already described constituent elements and signals in FIG. 9, and a description thereof will be omitted. As can be seen from comparison between FIG. 9 and FIG. 3, this element substrate is characterized by including a temperature detection circuit 106, a temperature control circuit 107, and an error output selection circuit 108 in addition to the arrangement of the element substrate explained in the first embodiment. According to the definition of a function circuit described in the first embodiment, these circuits also perform specific functions and can therefore be defined as function circuits.

Referring to FIG. 9, the temperature detection circuit 106 detects the resistance value (analog signal) of a temperature detection element, for example, a diode sensor integrated on an element substrate 101, and outputs it as temperature information TEMP from a temperature information output terminal 215 to a controller 600 of a printing apparatus. This output is done at a timing when the element substrate 101 receives an instruction signal from the controller 600. Additionally, in the controller 600, an A/D converter 606 converts the output temperature information into a digital signal. An MPU 601 analyzes the information and transmits a temperature control instruction signal based on the analysis result to the element substrate 101 by a data signal DATA.

A data reception circuit 102 extracts the temperature control instruction signal from the received data signal, and drives the temperature control circuit 107 based on data included in the instruction signal, thereby controlling the temperature of the element substrate 101. Examples of data included in the instruction signal are start instruction data and stop instruction data. The temperature control circuit 107 drives a heater integrated on the element substrate 101 for a time according to the instruction signal, thereby warming up the element substrate 101. A driving circuit 110 includes the heater integrated on the element substrate 101 and a transistor that drives the heater. Note that in a case where it is configured as another embodiment that the driving circuit 110 includes a plurality of heaters integrated on the element substrate 110 and a plurality of transistors driving the plurality of heaters, the start instruction data and the stop instruction data are prepared for each of the plurality of heaters.

In accordance with detection element selection data included in a selection instruction input from the controller 600 of the printing apparatus, the error output selection circuit 108 selects a detection signal output from various detection elements (sensors) 111 integrated on the element substrate 101 and configured to monitor the state of the element substrate. The error output selection circuit 108 then outputs the selected detection signal as error information ERROR from an error information output terminal 216 to the controller 600 of the printing apparatus.

As shown in FIG. 9, the temperature detection circuit 106, the temperature control circuit 107, and the error output selection circuit 108 are provided with shift registers 209, 211, and 213 and latch circuits 210, 212, and 214, respectively. A reset signal RST5 in which an error detection result RST2 is reflected is input to the shift registers 209 and 211 of the temperature detection circuit 106 and the temperature control circuit 107, as in a print element selection circuit 103. The shift registers 209 and 211 are thus reset at the time of a transfer error.

The temperature detection circuit 106 detects temperature information from a plurality of temperature detection elements 109. For this reason, if a transfer error occurs, it is impossible to determine from which temperature detection element the temperature information is being transferred. However, since the temperature detection circuit 106 according to this embodiment includes the shift register 209, the temperature information TEMP is fixed to a specific signal level when resetting the contents by the reset signal RST5 in which the error detection result RST2 is reflected. Hence, upon receiving the temperature information TEMP of the specific level, the controller 600 of the printing apparatus determines that it is obviously an abnormal output and inhibits use of the temperature information.

Additionally, when a plurality of element substrates are integrated in a printhead 3, to decrease the number of terminals of the printhead, the pieces of temperature information TEMP from the plurality of element substrates are bundled and output to one signal line in some case. In this arrangement, if the circuit is configured such that the output of the temperature information TEMP from an element substrate including a reset shift register becomes OPEN, conflict of logics by the outputs from the plurality of element substrates can be avoided.

In addition, the contents of the shift register 211 of the temperature control circuit 107 are reset to the value of stop instruction data by the reset signal RST5 in which the error detection result RST2 is reflected. When a latch signal is input, the latch circuit 212 latches the stop instruction data. Hence, in a case in which the printing apparatus transmits the temperature control instruction signal to stop temperature control, even if the transmission causes a transfer error, the contents of the shift register 211 are reset, and the temperature control can forcibly be stopped. This can prevent unexpected temperature control from being performed.

On the other hand, the shift register 213 and the latch circuit 214 of the error output selection circuit 108 have the same input arrangement as a drive time generation circuit 104. Additionally, when a plurality of types of error signals exist in correspondence with various detection elements provided on the element substrate 101, to decrease the number of output terminals from the element substrate 101, the error output selection circuit 108 is configured to output only a selected error signal. Each of the shift register 213 and the latch circuit 214 holds a selection instruction signal (detection element selection data) received from the controller 600 of the printing apparatus and representing which detection element is to be selected.

For this reason, if the shift register 213 is reset by the reset signal RST5 in which the error detection result RST2 is reflected, as in the temperature detection circuit 106 or the temperature control circuit 107, selected error information cannot be output. Hence, like the drive time generation circuit 104, a result signal of a NAND operation between a data presence/absence discrimination result RST1 and a latch signal RST3 in which the error detection result RST2 is reflected is used to reset the latch circuit 214. Accordingly, even if a transfer error occurs, previously latched data can be used, and selected error information is continuously output.

Hence, according to the above-described embodiment, even if a transfer error from the printing apparatus to the element substrate occurs, signal output or control can individually be executed in accordance with the role of each function circuit. For example, the shift registers in some function circuits can be reset by the reset signal in which the error detection result is reflected, and the latch circuits in the remaining function circuits can perform latch by the latch signal in which the error detection result is reflected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-097513, filed May 16, 2017, and No. 2018-082462, filed Apr. 23, 2018, which are hereby incorporated by reference herein in their entirety.

What is claimed is:

1. An element substrate on which a plurality of print elements and a plurality of drive elements configured to drive the plurality of print elements are integrated, comprising:

a plurality of function circuits configured to execute a plurality of functions necessary to execute a print operation;

a data discrimination circuit configured to receive a data signal from an outside, discriminate a type of data included in the received data signal, and transfer the received data signal to a corresponding function circuit of the plurality of function circuits in accordance with a result of the discrimination;

an error detection circuit configured to receive the data signal and detect whether a transfer error occurs in the received data signal; and a control circuit configured to control to reflect a detection result of the error detection circuit in a latch signal received from the outside and a reset signal received from the outside and, in accordance with the functions executed by the plurality of function circuits, cause some function circuits of the plurality of function circuits to latch the transferred data signal by the latch signal on which the detection result is reflected and cause remaining function circuits of the plurality of function circuits to reset the transferred data signal by the reset signal in which the detection result is reflected.

2. The element substrate according to claim 1, wherein each of the plurality of function circuits includes:

a shift register configured to hold the received data signal transferred from the data discrimination circuit; and a latch circuit configured to latch the data signal held by the shift register, the shift register is reset by one of the received reset signal and the reset signal in which the detection result is reflected, and the latch circuit performs latch by one of the received latch signal and the latch signal in which the detection result is reflected.

3. The element substrate according to claim 2, wherein the data signal includes a print element selection data signal and a drive time data signal, the plurality of function circuits include:

a selection circuit configured to select a print element to be driven from the plurality of print elements based on the print element selection data signal; and a generation circuit configured to generate a drive time of the print element to be driven based on the drive time data signal, a shift register in the selection circuit is reset by the reset signal in which the detection result is reflected, and a latch circuit in the generation circuit performs latch by the latch signal in which the detection result is reflected.

4. The element substrate according to claim 3, wherein the control circuit includes a latch circuit configured to latch the received latch signal and the detection result, and a latch circuit in the selection circuit is further reset based on the latch signal which is latched by the latch circuit in the control circuit and in which the detection result is reflected.

5. The element substrate according to claim 2, wherein the plurality of function circuits further include:

a temperature detection circuit configured to output, based on an instruction received from the outside, temperature information detected by a temperature detection element integrated on the element substrate to the outside;

a temperature control circuit configured to control, based on an instruction received from the outside, a temperature of the element substrate by driving a heater integrated on the element substrate; and an error output selection circuit configured to select, based on an instruction received from the outside, one of detection signals from a plurality of detection elements integrated on the element substrate and output the selected detection signal as an error signal.

6. The element substrate according to claim 5, wherein a shift register in the temperature detection circuit and a shift register in the temperature control circuit are reset by the reset signal in which the detection result is reflected, and a latch circuit in the error output selection circuit performs latch by the latch signal in which the detection result is reflected.

7. The element substrate according to claim 1, wherein the control circuit performs output and stop of the latch signal to some function circuits of the plurality of function circuits based on the detection result of the error by the error detection circuit.

8. The element substrate according to claim 1, further comprising a plurality of input terminals each configured to receive the data signal in accordance with a type of the data signal, wherein the data discrimination circuit and the error detection circuit comprise a plurality of data discrimination circuits and a plurality of error detection circuits, respectively, in accordance with the types.

9. The element substrate according to claim 1, wherein the plurality of print elements are time-divisionally driven by the plurality of drive elements, and in accordance with data to be updated and data not to be updated for each period of a block in the time-divisional driving, the control circuit causes the function circuits to latch the transferred data signal by the latch signal in which the detection result is reflected or causes the function circuits to reset the transferred data signal by the reset signal in which the detection result is reflected.

10. A printhead comprising:

a plurality of print elements;

a plurality of drive elements configured to drive the plurality of print elements;

a plurality of function circuits configured to execute a plurality of functions necessary to execute a print operation;

a data discrimination circuit configured to receive a data signal from an outside, discriminate a type of data included in the received data signal, and transfer the received data signal to a corresponding function circuit of the plurality of function circuits in accordance with a result of the discrimination;

an error detection circuit configured to receive the data signal and detect whether a transfer error occurs in the received data signal; and a control circuit configured to control to reflect a detection result of the error detection circuit in a latch signal received from the outside and a reset signal received from the outside and, in accordance with the functions executed by the plurality of function circuits, cause some function circuits of the plurality of function circuits to latch the transferred data signal by the latch signal in which the detection result is reflected and cause remaining function circuits of the plurality of function circuits to reset the transferred data signal by the reset signal in which the detection result is reflected.

11. The printhead according to claim 10, wherein the printhead comprises an inkjet printhead.

12. A printing apparatus comprising:

a printhead; and a controller configured to transfer a data signal, a latch signal, and a reset signal to the printhead to print on a print medium using the printhead, wherein the printhead comprises:

a plurality of print elements;

a plurality of drive elements configured to drive the plurality of print elements;

a plurality of function circuits configured to execute a plurality of functions necessary to execute a print operation;

a data discrimination circuit configured to receive a data signal from the controller, discriminate a type of data included in the received data signal, and transfer the received data signal to a corresponding function circuit of the plurality of function circuits in accordance with a result of the discrimination;

an error detection circuit configured to receive the data signal and detect whether a transfer error occurs in the received data signal; and a control circuit configured to control to reflect a detection result of the error detection circuit in a latch signal received from the controller and a reset signal received from the outside and, in accordance with the functions executed by the plurality of function circuits, cause some function circuits of the plurality of function circuits to latch the transferred data signal by the latch signal in which the detection result is reflected and cause remaining function circuits of the plurality of function circuits to reset the transferred data signal by the reset signal in which the detection result is reflected.

13. A printhead comprising:

a first reception terminal configured to receive a data signal;

a second reception terminal configured to receive a latch signal;

a third reception terminal configured to receive a reset signal;

a plurality of print elements;

a plurality of drive elements configured to drive the plurality of print elements;

a discrimination circuit configured to discriminate a type of data included in the data signal received by the first reception terminal;

an error detection circuit configured to detect whether a transfer error occurs in the data signal;

a plurality of function circuits each including a shift register configured to hold the data included in the data signal and a latch circuit configured to latch the data held by the shift register, and configured to execute a plurality of functions necessary to drive the plurality of drive elements;

a data transfer circuit configured to transfer the received data signal to a corresponding function circuit of the plurality of function circuits in accordance with a discrimination result of the discrimination circuit;

a latch signal control circuit configured to control whether to output the latch signal to some function circuits of the plurality of function circuits based on the latch signal received by the second reception terminal and a detection result of the error by the error detection circuit; and a reset signal control circuit configured to, at a timing of receiving the reset signal by the third reception terminal, transfer the reset signal to remaining function circuits of the plurality of function circuits, and at a timing of not receiving the reset signal by the third reception terminal, internally generate the reset signal upon detecting the error by the error detection circuit and transfer the reset signal to the remaining function circuits of the plurality of function circuits.

14. The printhead according to claim 13, wherein in a case where the error detection circuit detects occurrence of the error, the latch signal control circuit stops transfer to the some function circuits of the plurality of function circuits even if the latch signal is received.

15. The printhead according to claim 13, wherein the discrimination circuit further determines presence/absence of reception of data of a predetermined type, and if the data of the predetermined type is not received, makes a notification to the latch signal control circuit, and the latch signal control circuit stops output of the latch signal to the function circuits based on the notification even if the latch signal is received.

16. The printhead according to claim 13, wherein the data signal includes print element selection data and drive time generation data, the some function circuits of the plurality of function circuits include a selection circuit configured to select a print element to be driven from the plurality of print elements based on the print element selection data, and the remaining function circuits of the plurality of function circuits include a generation circuit configured to generate a drive time of the print element to be driven based on the drive time generation data.

17. The printhead according to claim 16, wherein the print element selected by the selection circuit is time-divisionally driven, and the printhead receives the data signal and the latch signal for each period of a block in the time-divisional driving.

18. The printhead according to claim 13, wherein the plurality of function circuits further include:

a temperature detection circuit configured to output temperature information detected by a temperature detection element integrated on the printhead;

a temperature control circuit configured to control a temperature of the printhead by driving a heater integrated on the printhead; and an error output selection circuit configured to select one of detection signals from a plurality of detection elements integrated on the printhead and output the selected detection signal as an error signal.

19. A printing apparatus comprising:

a printhead; and a controller configured to transfer a data signal, a latch signal, and a reset signal to the printhead to print on a print medium using the printhead, wherein the printhead comprises:

a plurality of print elements;

a plurality of drive elements configured to drive the plurality of print elements;

a discrimination circuit configured to discriminate a type of data included in the data signal transferred from the controller;

an error detection circuit configured to detect whether a transfer error occurs in the data signal;

a plurality of function circuits each including a shift register configured to hold the data included in the data signal and a latch circuit configured to latch the data held by the shift register, and configured to execute a plurality of functions necessary to drive the plurality of drive elements;

a data transfer circuit configured to transfer the received data signal to a corresponding function circuit of the plurality of function circuits in accordance with a discrimination result of the discrimination circuit;

a latch signal control circuit configured to control whether to output the latch signal to some function circuits of the plurality of function circuits based on the latch signal transferred from the controller and a detection result of the error by the error detection circuit; and a reset signal control circuit configured to, at a timing of receiving the reset signal from the controller, transfer the reset signal to remaining function circuits of the plurality of function circuits, and at a timing of not receiving the reset signal from the controller, generate the reset signal in the printhead upon detecting the error by the error detection circuit and transfer the reset signal to the remaining function circuits of the plurality of function circuits.

20. The printing apparatus according to claim 19, wherein the printhead comprises an inkjet printhead.

* * * * *